US010468791B1

(12) United States Patent
Humphrey et al.

(10) Patent No.: US 10,468,791 B1
(45) Date of Patent: Nov. 5, 2019

(54) TERMINAL BLOCK

(71) Applicants: TE CONNECTIVITY CORPORATION, Berwyn, PA (US); TE CONNECTIVITY INDIA PRIVATE LIMITED, Karnataka (IN)

(72) Inventors: David Tracy Humphrey, Red Lion, PA (US); G. Gunasekhar, Chittoor (IN)

(73) Assignees: TE CONNECTIVITY CORPORATION, Berwyn, PA (US); TE CONNECTIVITY INDIA PRIVATE LIMITED, Karnataka (IN)

( * ) Notice: Subject to any disclaimer, the term of this patent is extended or adjusted under 35 U.S.C. 154(b) by 0 days.

(21) Appl. No.: 16/031,128

(22) Filed: Jul. 10, 2018

(30) Foreign Application Priority Data

May 25, 2018 (IN) ..... 201811019708

(51) Int. Cl.

| | |
|---|---|
| ***H01R 9/22*** | (2006.01) |
| ***H01R 9/24*** | (2006.01) |
| ***H01R 11/12*** | (2006.01) |
| ***H01R 4/30*** | (2006.01) |
| ***H01R 4/18*** | (2006.01) |

(52) U.S. Cl.
CPC ..... *H01R 9/24* (2013.01); *H01R 4/185* (2013.01); *H01R 4/305* (2013.01); *H01R 11/12* (2013.01)

(58) Field of Classification Search
CPC ..... H01R 9/24; H01R 4/185; H01R 11/12; H01R 9/2408; H01R 13/518; H01R 4/2462
USPC ..... 439/709
See application file for complete search history.

(56) References Cited

U.S. PATENT DOCUMENTS

| | | | | |
|---|---|---|---|---|
| 2,786,190 A | | 3/1957 | Stahl | |
| 2,909,756 A | * | 10/1959 | Sitz | H01R 13/518 439/721 |
| 4,195,194 A | * | 3/1980 | Kuster | H01R 4/2462 174/59 |
| 4,210,379 A | * | 7/1980 | Vachhani | H01R 9/2408 439/406 |
| 4,236,778 A | * | 12/1980 | Hughes | H01R 9/24 439/406 |
| 4,343,529 A | | 8/1982 | Reavis, Jr. et al. | |
| 7,527,523 B2 | | 5/2009 | Yohn et al. | |

* cited by examiner

*Primary Examiner* — Jean F Duverne

(57) ABSTRACT

A terminal block having an electrically insulative housing with terminal-receiving slots with dividers provided between the terminal-receiving slots. Fastener-receiving openings extend through upper surfaces of the terminal-receiving slots toward a lower surface of the housing. The electrical terminal includes a wire barrel configured for crimped connection with an end of a conductive core of an insulated wire and an insulation barrel configured for crimped connection with an end of the insulation coating or jacket of the wire. A contact portion extends from the wire barrel and is positioned in a terminal-receiving slot of the terminal block housing. The contact portion has an opening proximate the center of the contact portion. Corners of the contact portion form securing members. An eyelet tube extends from the opening in the contact portion. The eyelet tube is deep drawn to form a screw-receiving member.

16 Claims, 7 Drawing Sheets

TERMINAL BLOCK

FIELD OF THE INVENTION

The invention is directed to terminal blocks and electrical terminals for use in a terminal block which provide a secure and positive electrical connection while optimizing material used.

BACKGROUND OF THE INVENTION

Terminal blocks and electrical terminals for use in terminal blocks are well known in the industry. Terminal blocks are used for joining electrical conductors of the same or different sizes and to electrically couple the same together in a conventional manner.

A wide variety of power terminal assemblies exist for use today, depending upon the environment and application for which it is intended. In some applications, multiple sets of wires within an end product are joined within the power terminal assembly to external power cords and other types of wire. Examples of this application may be found in various environments, such as in appliances and other industrial applications.

In general, conventional power terminal blocks or assemblies include a housing formed of an insulative material and shaped to provide one or more regions therein to receive conductive power terminals. Each power terminal is configured to join a power line from the end product (e.g., an electrical device) and a corresponding power cord from the power source. Each power terminal is held within the insulated housing of the power terminal assembly through a separate fastening means, such as screws or similar electrical connection devices. Known power terminals have a screw receiving area which is proximate to but spaced from a latching area. This provides sufficient area to properly conduct the electrical current associated with high power demand while providing sufficient latching to maintain the power terminals in position in the terminal block. However, known power terminals are large to provide sufficient redundancy, thereby requiring sufficient material to be used in the manufacture of the terminal blocks and the terminals. In addition, in known terminal blocks, mounting hardware is needed to secure the screws. The mounting hardware may be dropped or dislodged which could result in damage to the terminal block or the equipment to which it is attached.

What is needed is a power terminal and terminal block which provides a secure and positive electrical connection while optimizing material used and which minimizes loose pieces to prevent damage to the power terminal, terminal block and the equipment to which it is attached.

SUMMARY OF THE INVENTION

An embodiment is directed to a terminal block having an electrically insulative housing and electrical terminals. The electrically insulative housing has terminal-receiving slots with dividers provided between the terminal-receiving slots. The terminal-receiving slots extend from a first surface of the housing to a wall provide proximate a second surface of the housing. Terminal-receiving cavities extend through the second surface and walls to the terminal-receiving slots. Wire-receiving recesses extend through the first surface to the terminal-receiving slots. Fastener-receiving openings extend through upper surfaces of the terminal-receiving slots toward a lower surface of the housing. The fastener-receiving openings are positioned between the terminal-receiving cavities and the wire-receiving recesses. Securing member receiving areas are provided between the wire-receiving recesses and the terminal-receiving cavities. The securing member receiving areas extend through the upper surfaces of the terminal-receiving slots toward the lower surface of the housing. The electrical terminals have contact portions, with the contact portions positioned in the terminal-receiving slots. The contact portions have openings proximate the center of the contact portions. Corners of the contact portions form securing members.

An embodiment is directed to a terminal block having an electrically insulative housing, electrical terminals and mounting hardware. The electrically insulative housing has terminal-receiving slots with dividers provided between the terminal-receiving slots. The terminal-receiving slots extend from a first surface of the housing toward a second surface of the housing. Fastener-receiving openings extend through upper surfaces of the terminal-receiving slots toward a lower surface of the housing. The electrical terminals have contact portions. The contact portions are positioned in the terminal-receiving slots and have openings proximate the center thereof. Eyelet tubes extend from the openings in the contact portions. The eyelet tubes are deep drawn to form screw-receiving members. The eyelet tubes extending into the fastener-receiving openings. Mating hardware is positioned in the openings of the contact portions and the eyelet tubes.

An embodiment is directed to an electrical terminal for use in a terminal block housing. The electrical terminal includes a wire barrel configured for crimped connection with an end of a conductive core of an insulated wire and an insulation barrel configured for crimped connection with an end of the insulation coating or jacket of the wire. A contact portion extends from the wire barrel and is positioned in a terminal-receiving slot of the terminal block housing. The contact portion has an opening proximate the center of the contact portion. Corners of the contact portion form securing members. An eyelet tube extends from the opening in the contact portion. The eyelet tube is deep drawn to form a screw-receiving member.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
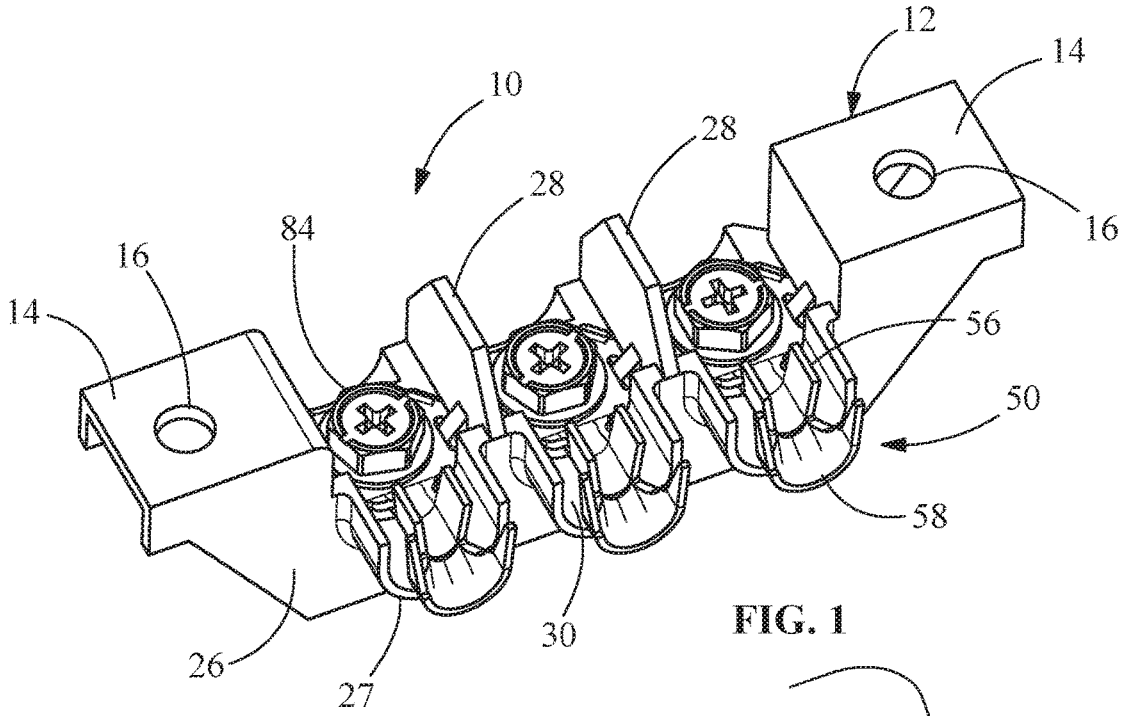
FIG. 1 is a top perspective view of an illustrative embodiment of the terminal block of the present invention with terminals positioned in terminal receiving slots.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

Figure 2:
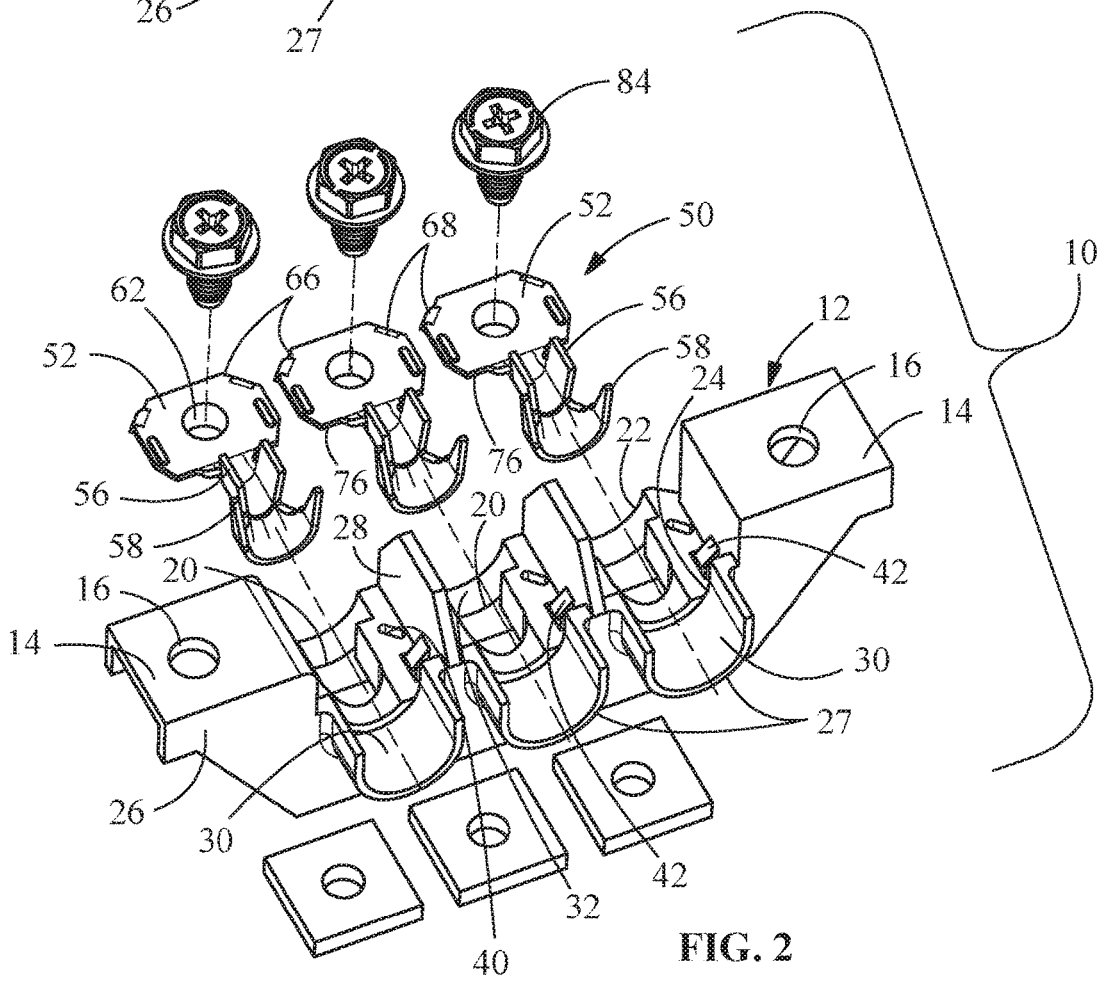
FIG. 2 is an exploded perspective view of the terminal block of FIG. 1.

As best shown in FIGS. 1 and 2, the electrical connector or terminal block 10 has a housing 12 formed from an electrically insulative material, such as, but not limited to, thermoset material or thermoplastic material.

In the embodiment shown, mounting flanges 14 extend from the housing 12. The mounting flanges 14 have mounting openings 16. The mounting openings 16 may include machined openings or formed openings configured to receive a fastener. The configuration of mounting flanges and mounting openings 16 may be any geometry that provides the capability of fastening the terminal block 10 in a location having the desired accessibility.

As best shown in FIG. 2, the housing 12 has terminal-receiving slots 20 which extend from a front of first surface 22 of the housing 12 through to a wall 24 provided proximate a rear or second surface 26. In the embodiment shown, the housing 12 has three slots 20, but other number of slots may be provided without departing from the scope of the invention. In order to provide separation between the slots 20, side walls or dividers 28 are disposed between the slots 20. Additional walls or dividers 28 are provided at the ends of the housing 12. In the embodiment shown, the dividers 28 are integrally molded with the housing 12. However, the dividers 28 may be individual pieces fabricated from an insulating material, such as, but not limited to, thermoset material or thermoplastic material.

Figure 5:
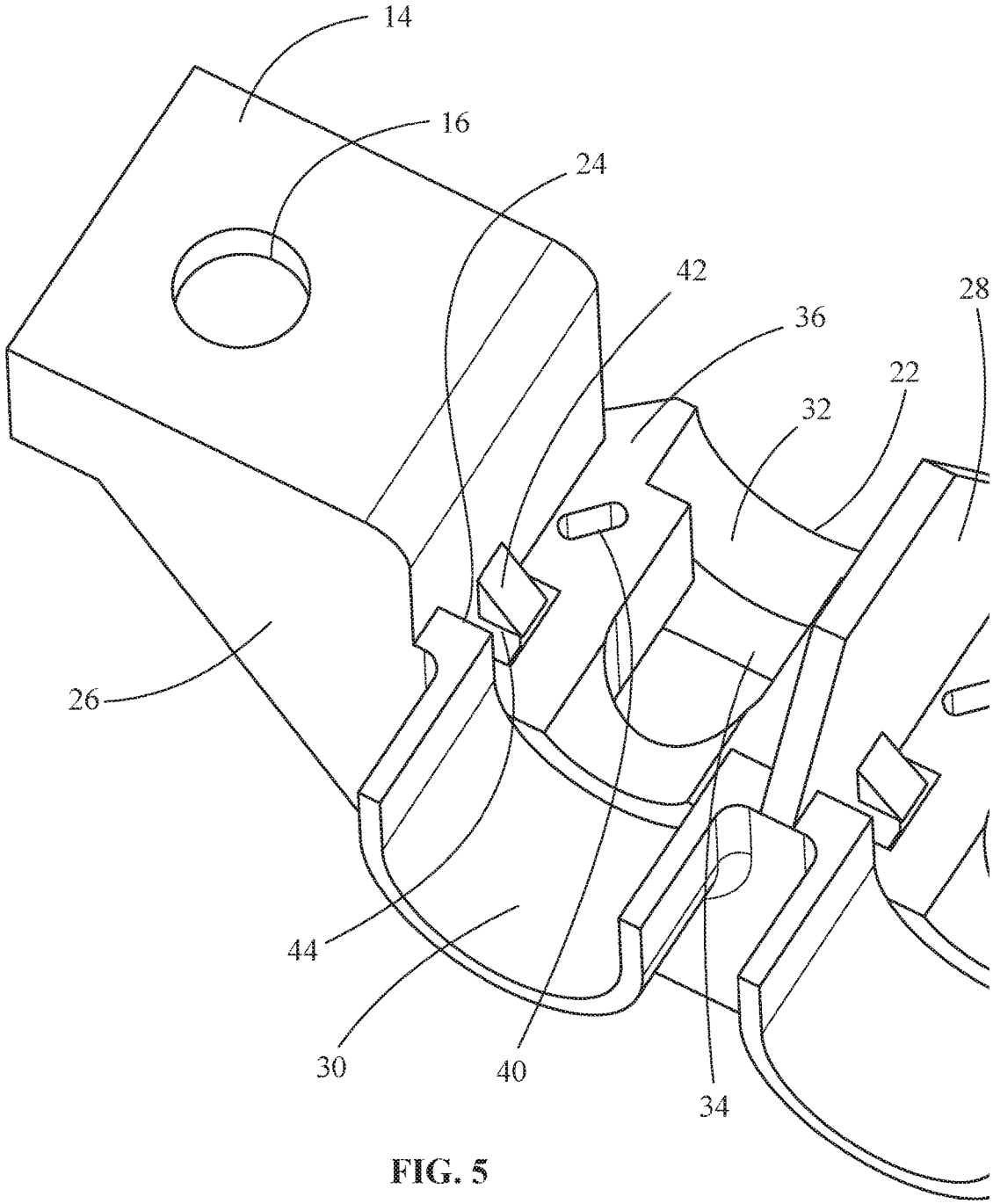
FIG. 5 is an enlarged perspective view of a terminal receiving slot of the terminal block of FIG. 1.

As best shown in FIG. 5, terminal-receiving cavities 30 extend through the second surface 26 and the walls 24 to the terminal-receiving slots 20. Wire-receiving recesses 32 extend through the first surface 22 to the slots 20. In the illustrative embodiment shown, the longitudinal axis of a respective slot 20, a respective terminal-receiving cavity 30 and a respective wire-receiving recess 32 are all in alignment.

Fastener-receiving openings 34 extend through top or upper surfaces 36 of the slots 20 toward a bottom or lower surface 38 (FIG. 7) of the housing 12. The fastener-receiving openings 34 are positioned between the terminal-receiving cavities 30 and the wire-receiving recesses 32. Securing member receiving areas 40 are provided between the wire-receiving recesses 32 and the terminal-receiving cavities 30. The securing member receiving areas 40 extend through surfaces 36 of the slots 20 toward a bottom surface 38 of the housing 12. The securing member receiving areas 40 may be, but are not limited to, an opening, a pocket or a recess.

Terminal hold-downs 42 extend from the walls or dividers 28 into the terminal-receiving slots 20. Terminal cooperation surfaces 44 of the terminal hold-downs 42 are spaced from the surfaces 36 of the slots 20. The spacing is approximate to, but slightly larger than, the thickness of the terminals 50. In the embodiment shown, the two triangular shaped terminal hold-downs 42 are provided in each terminal-receiving slot 20. However, other numbers and shapes of terminal hold-downs 42 may be provided.

Figure 3:
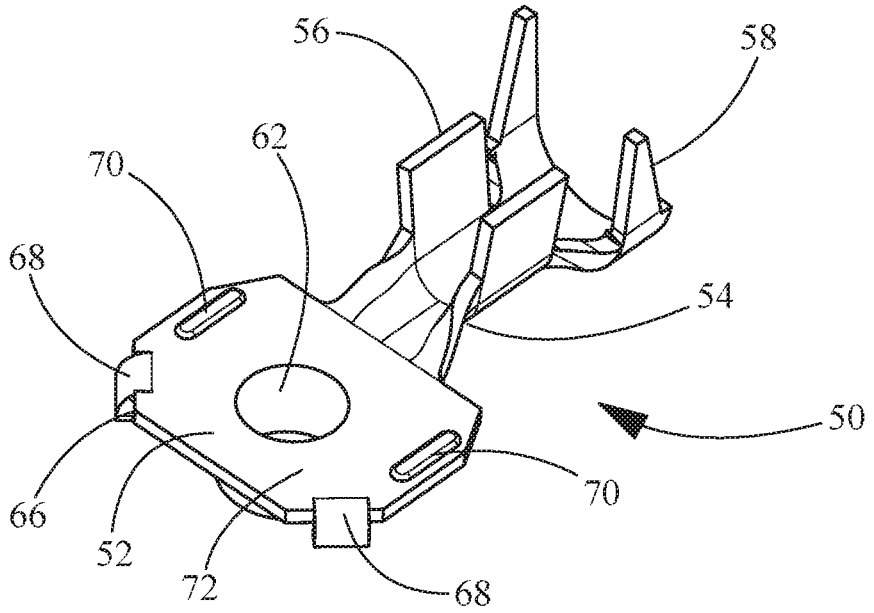
FIG. 3 is a perspective view of a terminal of FIG. 1.
Figure 4:
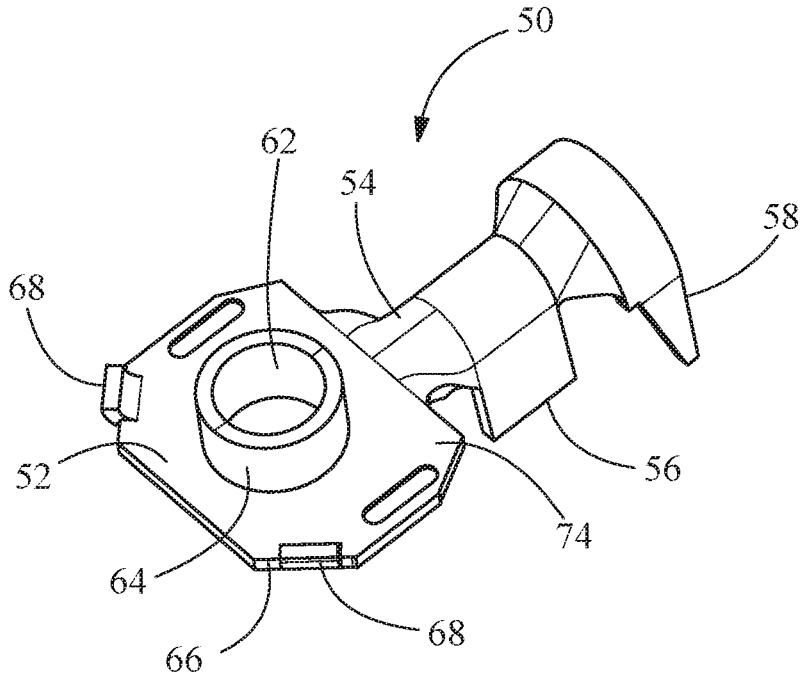
FIG. 4 is a side view of the terminal of FIG. 3.

As best shown in FIGS. 3 and 4, a representative electrical terminal 50 includes a contact portion 52, a transition portion 54, a wire barrel 56 and an insulation barrel 58. The wire barrel 56 is configured for crimped connection with an end of a conductive core of an insulated wire. The insulation barrel 58 is configured for crimped connection with an end of the insulation coating or jacket of the wire. Although the wire barrel 56 and the insulation barrel 58 are shown, other types of termination portions may be used without departing from the scope of the invention. In the illustrative embodiment shown, the terminal 50 is stamped and formed from a metal plate having a good electrical conductivity, such as, but not limited to, copper alloy.

The contact portions 52 are configured to be placed in electrical engagement with mating contacts or wires not shown). The contact portions 52 have a generally planar configuration. Openings 62 with eyelet tubes 64 are provided proximate the center of the contact portions 52. In the illustrative embodiment shown, the eyelet tubes 64 are deep drawn from the contact portions 52 to form screw-receiving members. Corners 66 of the contact portions 52 are stamped and formed to form securing members 68. In the embodiment shown, the securing members 68 are latches with a generally bent rectangular configuration. However, other configurations of the securing members may be used. For example, the securing members 68 may be barbs which extend downward from the corners 66.

Ribs or projections 70 extend from top surfaces 72 of the contact portions 52 in a direction away from the bottom surfaces 74 of the contact portions 52. The ribs or projections 70 are positioned to cooperate with the terminal hold-downs 42 when the terminals 50 are fully inserted into the terminal-receiving cavities 30.

Figure 6:
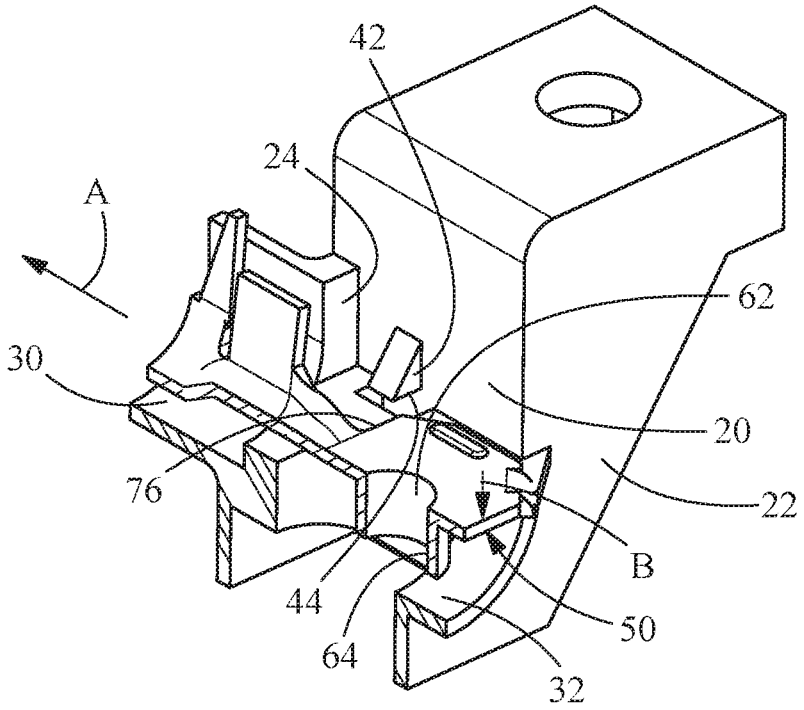
FIG. 6 is a cross-sectional view of the terminal of FIG. 3 partially inserted into the terminal receiving slot of FIG. 5.

During assembly, as shown in FIG. 6, the terminals 50 are positioned in the terminal-receiving cavities 30 such that the eyelet tubes 64 are initially placed in the wire-receiving recesses 32. In this position, the contact portions 52 are spaced from walls 24, and the securing members 68 engage the upper surfaces 36 of the terminal-receiving cavities 30.

Figure 7:
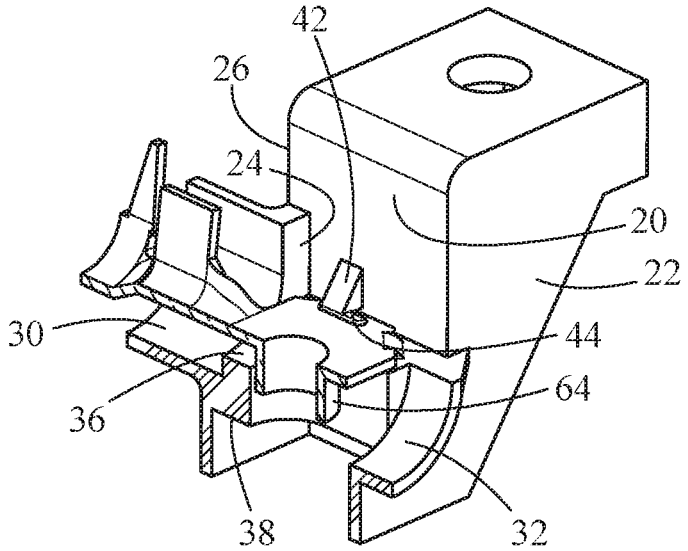
FIG. 7 is a cross-sectional view of the terminal of FIG. 3 fully inserted into the terminal receiving slot of FIG. 5.

The terminals are moved, as shown by arrows A and B in FIG. 6, to the fully inserted position shown in FIG. 7. In this fully inserted position, the eyelet tubes 64 are positioned in the fastener-receiving openings 34. Additionally, the securing members 68 are positioned in the securing member receiving areas 40, and the ribs or projections 70 are positioned in alignment with the terminal hold-downs 42. In this fully inserted position, edges 76 of the contact portions 52 are positioned proximate to or in engagement with walls 24.

The cooperation of the securing members 68 with the securing member receiving areas 40 and the ribs or projections 70 with the terminal hold-downs 42 prevents the unwanted movement or removal of the terminals 50 from the terminal-receiving cavities 30.

Wires (not shown), which may be used in appliances or the like, are terminated to the wire barrels 56 and the insulation barrels 58 of the terminals 50 using known methods. The wires may be terminated to the terminals 50 prior to inserting the terminals 50 in the terminal-receiving cavities 30 or after the terminals 50 are inserted into the terminal-receiving cavities 30.

With the terminals fully inserted into the housing 12 of the terminal block 10, the mating contacts are moved into position on the contact portions 52 of the terminals 50. Openings of the mating contacts 60 are aligned with the openings 62 and the eyelet tubes 64 of the contact portions. With the openings aligned, mating hardware 84 is positioned in the openings 62 and the eyelet tubes 64. The mating hardware 84 engages mounting nuts 86 and is tightened in a known manner.

In alternate embodiments, mating hardware 84 is rotated and cooperates with the eyelet tubes 64 to tighten the mating hardware 84 relative to the eyelet tubes 64 causing the mating contacts 60 to be placed and maintained in mechanical and electrical engagement with the contact portions 52 and the terminals 50, thereby allowing electrical current to flow from the power wires through the mating contacts 60 to the terminals 50 and through the wires 80. The use of the eyelet tubes 64 eliminates the need for traditional nuts as found in the known art. In such embodiments, the mating hardware 84 are thread-forming screws which are known in the industry. However, other types of mating hardware can be used.

Figure 8:
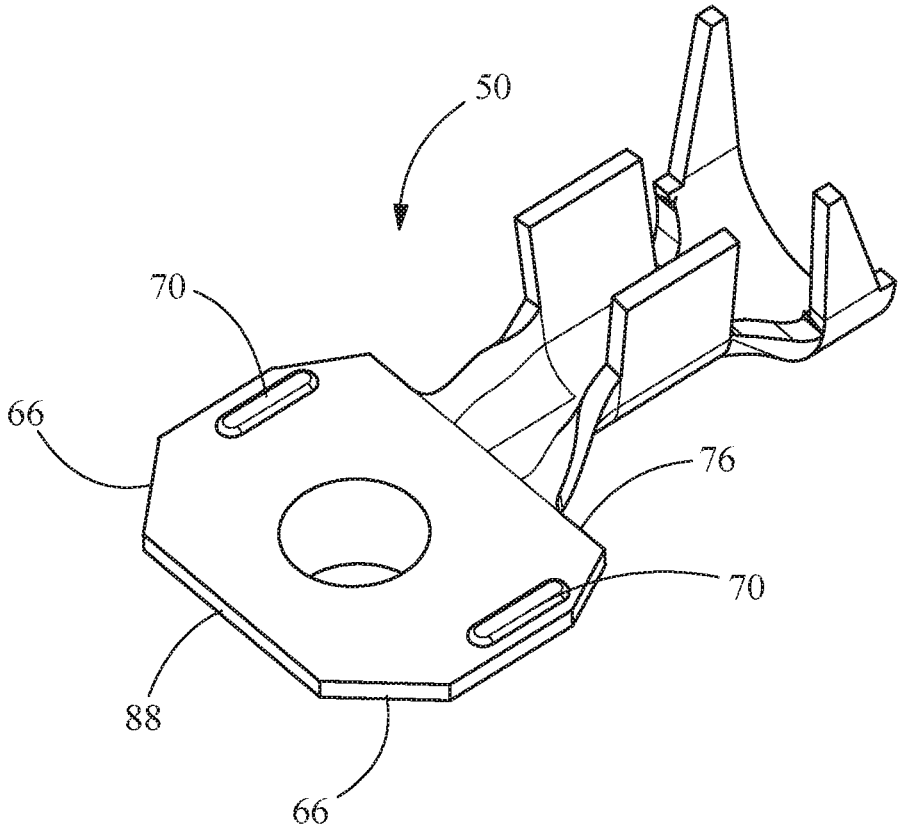
FIG. 8 is a perspective view of an alternate illustrative terminal.
Figure 9:
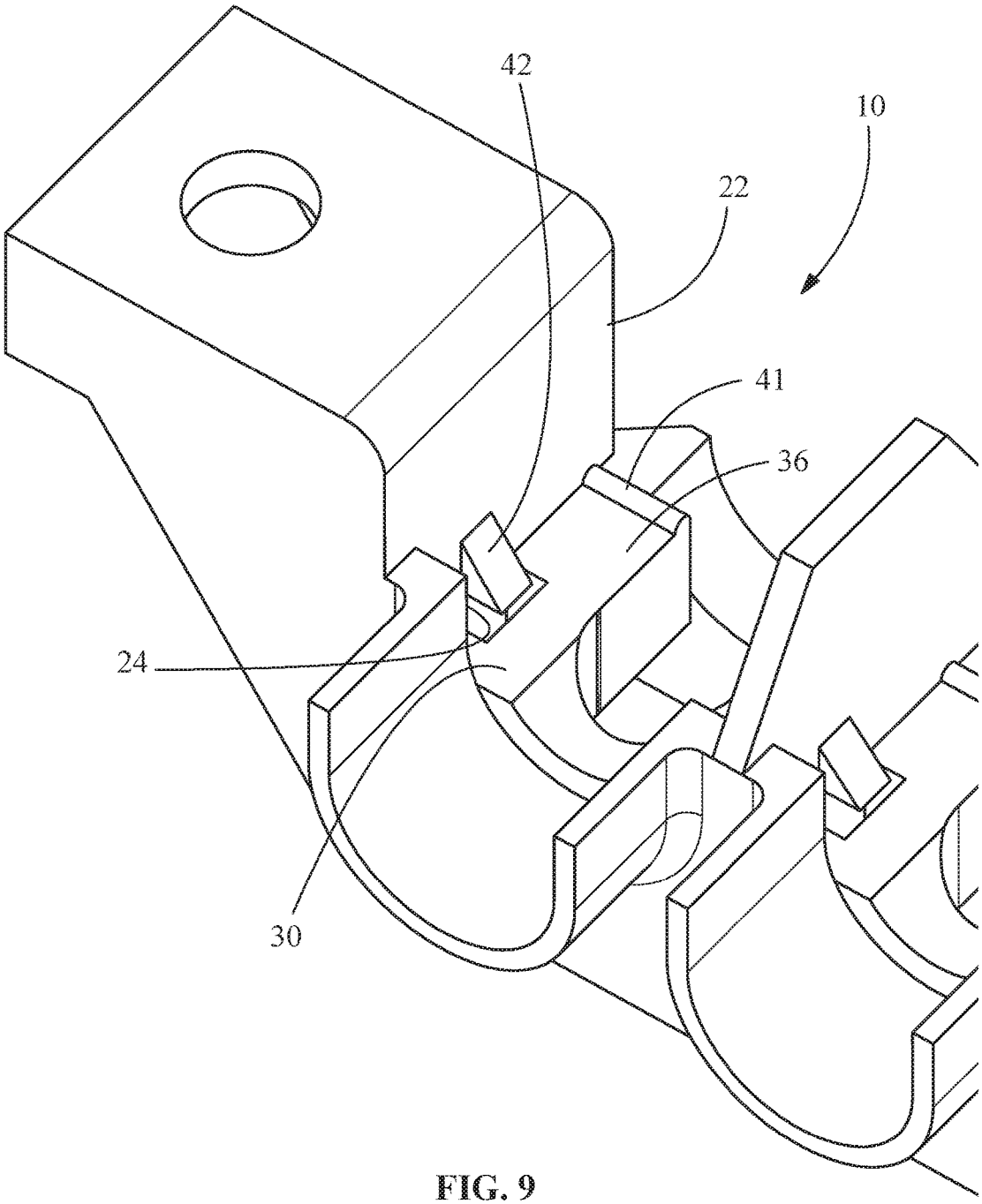
FIG. 9 is an enlarged perspective view of an alternate illustrative terminal receiving slot.
Figure 10:
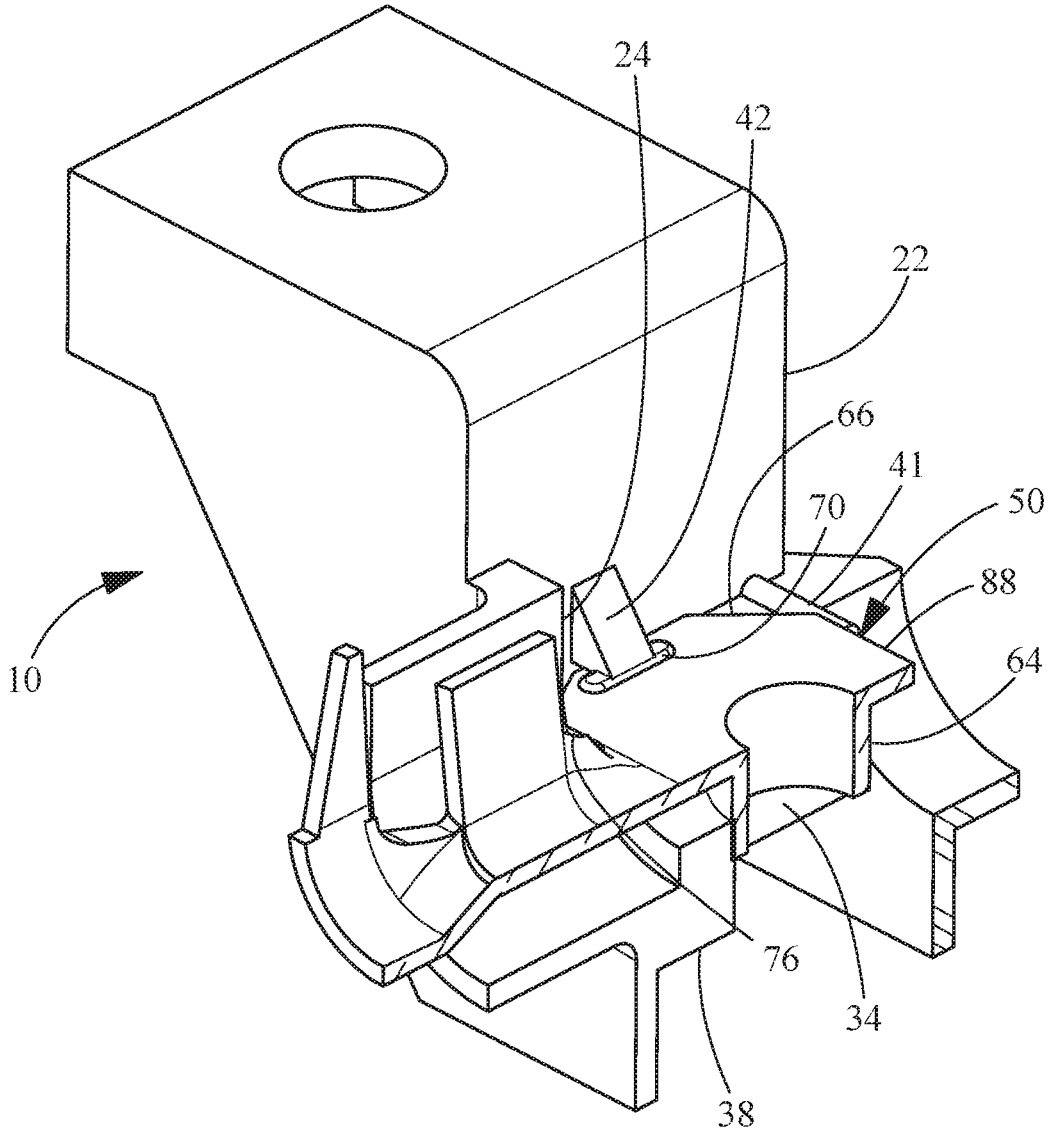
FIG. 10 is a cross-sectional view of the terminal of FIG. 8 fully inserted into the terminal receiving slot of FIG. 9.

An alternate illustrative embodiment is shown in FIGS. 8 through 10. In this embodiment, the terminals 50 are similar to the terminals of FIGS. 1 through 7. However, the terminals 50 do not have the securing members extending from the corners 66.

The housing 10 is similar to the housing of FIGS. 1, 2 and 5 through 7. However, the housing 10 does not have securing member receiving areas provided in the terminal-receiving cavities 30. Additionally, steps 41 are provided proximate the front or first surface 22 of the housing 12. The steps 41 extend in the terminal-receiving cavities 30 from the top or upper surfaces 36 in a direction away from the bottom or lower surface 38.

In the fully inserted position shown in FIG. 10, the eyelet tubes 64 are positioned in the fastener-receiving openings 34. Additionally, front edges 88 of the contact portions 52 are positioned proximate to or in engagement with steps 41. The ribs or projections 70 are positioned in alignment with the terminal hold-downs 42. In this fully inserted position, rear edges 76 of the contact portions 52 are positioned proximate to or in engagement with walls 24.

The cooperation of the front edges 88 with the steps 41, the rear edges 76 with the walls 24 and the ribs or projections 70 with the terminal hold-downs 42 prevents the unwanted movement or removal of the terminals 50 from the terminal-receiving cavities 30.

Referring to FIGS. 1 through 10, the configuration of the terminal block housing and terminals is optimized to reduce the amount of material needed to manufacture both the housing and the terminals. This provides a cost-effective terminal block which is reliable in various environments. The configuration of the terminals also reduces the amount of parts needed for assembly, thereby reducing the complexity of manufacture/assembly and facilitating cost reduction.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A terminal block comprising:

an electrically insulative housing having terminal-receiving slots with dividers provided between the terminal-receiving slots, the terminal-receiving slots extending from a first surface of the housing to a wall provided proximate a second surface of the housing, terminal-receiving cavities extending through the second surface and walls to the terminal-receiving slots, wire-receiving recesses extending through the first surface to the terminal-receiving slots, fastener-receiving openings extending through upper surfaces of the terminal-receiving slots toward a lower surface of the housing, the fastener-receiving openings positioned between the terminal-receiving cavities and the wire-receiving recesses, securing member receiving areas provided between the wire-receiving recesses and the terminal-receiving cavities, the securing member receiving areas extending through the upper surfaces of the terminal-receiving slots toward the lower surface of the housing, and terminal hold-downs extending from the dividers into the terminal-receiving slots, wherein terminal cooperation surfaces of the terminal hold-downs are spaced from the upper surfaces of the terminal-receiving slots; and electrical terminals having contact portions, the contact portions positioned in the terminal-receiving slots, the contact portions having openings proximate the center of the contact portions, wherein corners of the contact portions form securing members, and projections extend from top surfaces of the contact portions, wherein the projections cooperate with the terminal hold-downs when the terminals are fully inserted into the terminal-receiving slots.

2. The terminal block as recited in claim 1, wherein the housing has mounting flanges with mounting openings which are configured to receive fasteners therein.

3. The terminal block as recited in claim 1, wherein the housing has three terminal-receiving slots.

4. The terminal block as recited in claim 1, wherein the housing is made from thermoset material.

5. The terminal block as recited in claim 1, wherein the housing is made from thermoplastic material.

6. The terminal block as recited in claim 1, wherein the longitudinal axis of a respective slot of the terminal-receiving slots, a respective terminal-receiving cavity of the terminal-receiving cavities and a respective wire-receiving recess of the wire-receiving recesses are all in alignment.

7. The terminal block as recited in claim 1, wherein securing member receiving areas have openings which extend through the upper surfaces of the terminal-receiving slots toward the lower surface of the housing.

8. The terminal block as recited in claim 1, wherein the electrical terminals includes wire barrels configured for crimped connection with an end of a conductive core of an insulated wire and insulation barrels configured for crimped connection with an end of the insulation coating or jacket of the wire.

9. The terminal block as recited in claim 1, wherein the electrical terminals are made of a copper alloy.

10. The terminal block as recited in claim 1, wherein eyelet tubes extend from the openings in the contact portions, the eyelet tubes are deep drawn to form screw-receiving members.

11. The terminal block as recited in claim 1, wherein the securing members are latches with a generally bent rectangular configuration.

12. The terminal block as recited in claim 1, wherein the securing members are barbs which extend downward from the corners.

13. The terminal block as recited in claim 1, wherein projections extend from top surfaces of the contact portions, the ribs or projections cooperate with the terminal hold-downs.

14. A terminal block comprising:

an electrically insulative housing having terminal-receiving slots with dividers provided between the terminal-receiving slots, the terminal-receiving slots extending from a first surface of the housing toward a second surface of the housing, fastener-receiving openings extending through upper surfaces of the terminal-receiving slots toward a lower surface of the housing, securing member receiving areas extending through upper surfaces of the terminal-receiving slots, and terminal hold-downs extending from the dividers into the terminal-receiving slots, wherein terminal cooperation surfaces of the terminal hold-downs are spaced from the upper surfaces of the terminal-receiving slots;

electrical terminals having contact portions, the contact portions positioned in the terminal-receiving slots, the contact portions having openings proximate the center of the contact portions, eyelet tubes extend from the openings in the contact portions, the eyelet tubes are deep drawn to form screw-receiving members, the eyelet tubes extending into the fastener-receiving openings, wherein corners of the contact portions form securing members, and projections extend from top surfaces of the contact portions, wherein the projections cooperate with the terminal hold-downs when the terminals are fully inserted into the terminal-receiving slots; and mating hardware positioned in the openings of the contact portions and the eyelet tubes.

15. The terminal block as recited in claim 14, wherein the mating hardware are thread-forming screws.

16. The terminal block as recited in claim 14, wherein the housing has steps provided proximate the first surface of the housing, the steps extend into the terminal-receiving slots from the upper surface of the terminal-receiving slot.

* * * * *